United States Patent [19]

Roberts

[11] 4,388,936

[45] Jun. 21, 1983

[54] COMBINATION APPLICATOR-DISPENSER HAIR STYLER

[76] Inventor: Shephard D. Roberts, P.O. Box 136, Brooklyn, N.Y. 11216

[21] Appl. No.: 360,599

[22] Filed: Mar. 22, 1982

[51] Int. Cl.[3] ..... A45D 40/30

[52] U.S. Cl. ..... 132/88.5; 132/88.7

[58] Field of Search ..... 132/88.5, 88.7, 40, 132/42, 33 R

[56] References Cited

U.S. PATENT DOCUMENTS

| | | | |
|---|---|---|---|
| 2,768,634 | 10/1956 | Krauss et al. | 132/40 |
| 3,241,561 | 3/1966 | Richmond | 132/40 |
| 3,347,248 | 10/1967 | Weitzner | 132/40 |
| 3,376,875 | 4/1968 | Rosan | 132/40 |
| 3,515,154 | 6/1970 | Morgese | 132/88.5 |
| 3,957,066 | 5/1976 | Dahm | 132/88.7 |
| 4,211,247 | 7/1980 | Morganroth | 132/88.7 |

*Primary Examiner*—G. E. McNeill

[57] ABSTRACT

A durable upright spray container hair applicator-dispenser whose contents are a pressurized preparation applied to hair for treatment thereof. The container has an elogated circular domehead receptacle. The container also has a removable tubular cover which is elongated and has serrations or teeth axially thereon so that the cover can function to hold the hair strands. The elongated cover has a plurality of openings axially disposed and circumferentially spaced from the serrations thereon for applying the sprayed contents of the container-dispenser on hair for a particular treatment. The cover is covered by an elongated parallel band cover which is removable. The inside cover and band form a hair curler. The cover when removed from the circular domehead receptacle can function as a hair-roller on which hair can be rolled and the band slipped on axially over the hair and cover as a clip or clamp. The container is a multiple choice spray dispenser, and can be used without the roller attachments.

12 Claims, 3 Drawing Figures

COMBINATION APPLICATOR-DISPENSER HAIR STYLER

BACKGROUND OF THE INVENTION

This invention relates generally to treatment of hair and more particularly to a new and improved applicator-dispenser.

Applicator-dispensers used for hair stimulants and hair growers and the like are known. For example my U.S. Pat. No. 4,011,879. The device disclosed therein has a dispenser with an applicator top or cover used generally for treatment of hair. The contents thereof may be for example, a hair stimulant or grower for growing hair.

Morever, hair rollers of all types of construction are known. These rollers are constructed separately from any dispensers and hair rolling is accomplished with these rollers and then generally a dispenser is used for dispensing on the rolled hair a hair treatment preparation, etc.

SUMMARY OF THE INVENTION

The principal object of the present invention is to provide a new and improved container, applicator-dispenser having a circular dome receptacle; dispenser-cover and outside cover thereon usuable as a hair-roller and clamp in the manner of hair curlers.

Another object of the invention is to provide a container, applicator-dispenser to be made of durable plastic, metal or similar combination of materials with required bursting and sealing strength.

Also another object of the invention is a reusable container that can be filled and refilled with preparation by the user.

It is also another object of this invention to provide a changeability feature to a spray-only type container directly from the dome receptacle for special styling or spraying of hair.

A further object to provide a container for alternating contents preparation for hair, whether low or high pressure dispensing is required of the preparation. A combination-use container dependent upon the contents preparation.

It is a further object of the invention to provide a built-in mechanism and control of the contents within the container for release and outward flow.

The applicator-dispenser according to the invention is the use of a durable spray container coupled with a circular top dome receptacle head projector for contents and preparation therein usuable with application to hair. The dome funnel-head also closes the container, and is the liquid preparation inlet and refiller when the hair-roller is removed and the push-lever is pressed inward to meet a continuous opening into the container through the funnel vertical tube.

The hair curler is made up of a removable tubular and pliable roller cover on the container closed at one end and removably mounted over and on the circular dome-head receptacle. The roller cover has a plurality of axial openings for dispensing of contents of hair treatment preparation. The hair-roller has internal flanges and platforms that direct and guide the contents continous flow onto the apertures or openings when activated by the push lever spring when pressed inward.

On each corner of the hair-roller is provided with double-row set serrations or teeth to hold hair strands subsequent to application of the preparation for styling or whatever hair beauty. The rows of serrations having rounded edges tend to grip the hair strands securely upon removal and use thereof as a hair-roller by twisting or wrapping hair around the roller serrated sides. The horizontal side walls press against the platform edges, closing the open spaces between the platform edges and wall and the dispensed contents within accurately flow out and onto all apertures or holes onto the rolled hair, when inserted into the circular dome receptacle head and activated by the push lever.

The applicator-dispenser is provided with a removal outside cover which is axially over the roller-cover when being used as a hair-roller to clamp or clip the hair onto the hair-roller cover. This outside cover is open at both ends and is likewise elongated shaped and holds the hair tightly on the inner core or hair-roller for quick curling and styling. And when not in use the hair-roller cover and outside band cover is retained on the container.

BRIEF DESCRIPTION OF THE DRAWINGS

The above and other objects of the dispenser-applicator according to the invention will be readily evident upon the study of the following specification, claims and accompanying drawings in which:

DESCRIPTION OF THE PREFERRED EMBODIMENTS

Figure 1:
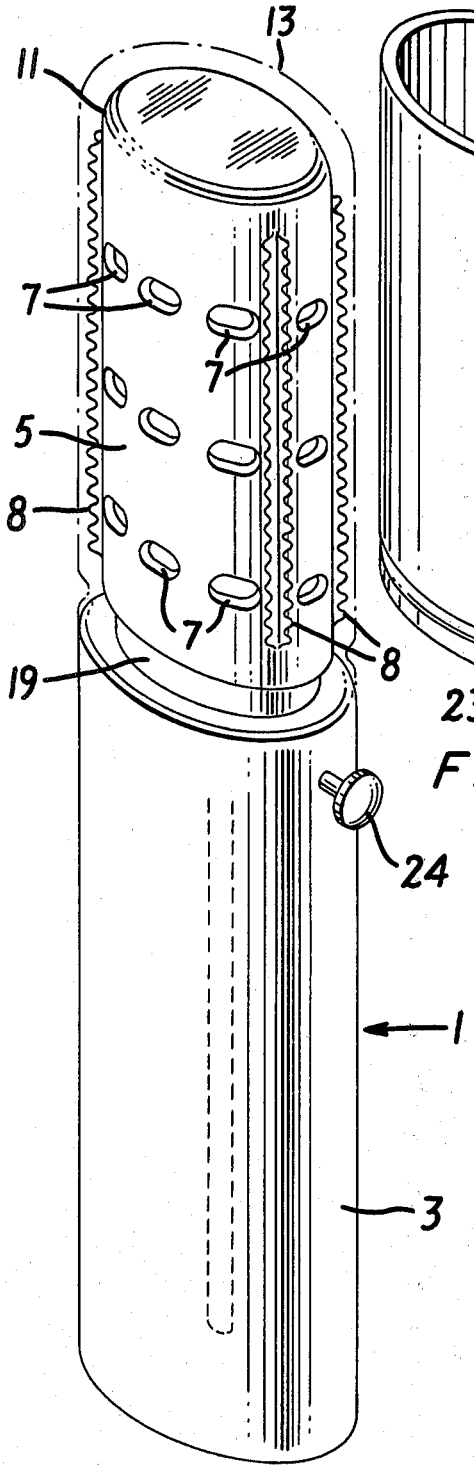
FIG. 1 is a side elevation view of an applicator-dispenser according to the invention.

An applicator-dispenser 1 according to the invention comprises a durable upright container 3 within which contains pressurized liquid hair treatment preparation, which may be a hair conditioner, pressing oil, lotion or hair straightner oil applied on the hair strands when pressure is exerted on the actuator-lever. The container is provided with a dome 19 coupled with a cover 5 having axially spaced four double-row set beads 8, each having an opening 7 through the contents of the dispenser are applied. The cover is elongated shaped so that the contents can be readily on hair through the apertures or holes 7.

The dispenser cover is provided on each corner double-row set beads with serrations or teeth 8 that have rounded edges. The serrated portion serves to hold the hair more evenly when the preparation is applied from the dispenser. The dispenser cover is also provided with an outside cover 13 which clips or slides on the inside cover 5 as shown on FIG. 1, and is likewise elongated. The dispenser 5 slides down onto the dome 19 through the cut-away opening more readily seen in FIG. 2 sectional view line 3—3.

Figure 4:
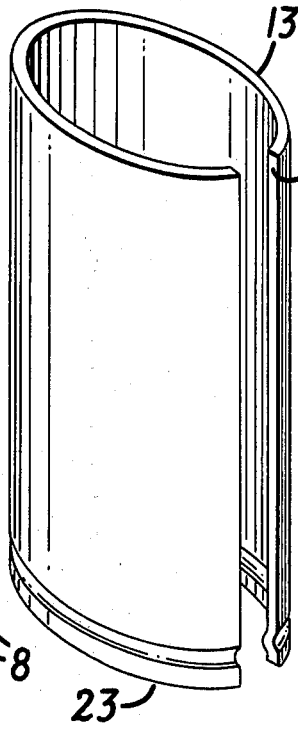
FIG. 4 is a side elevation view embodiment of the band or outside cover of the applicator-dispenser in FIG. 1.
Figure 2:
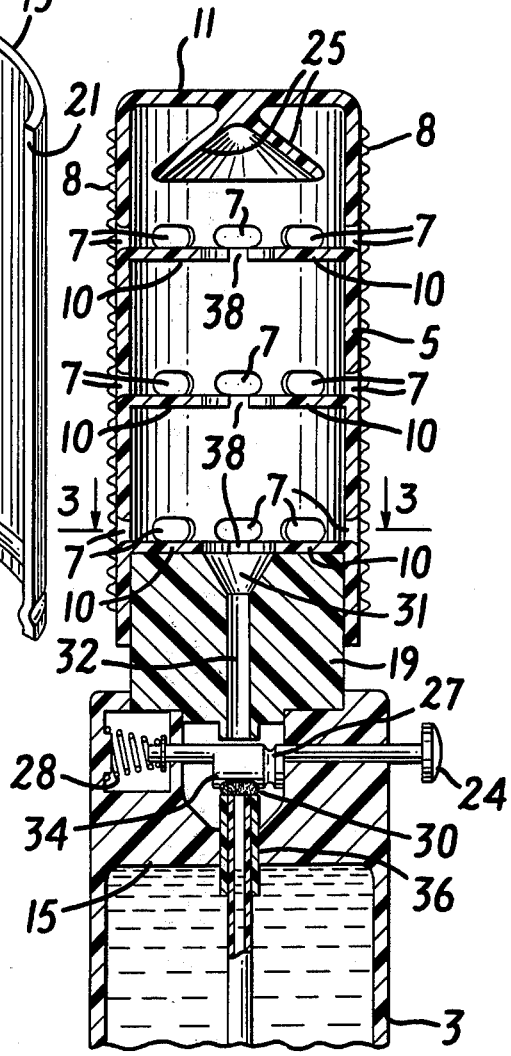
FIG. 2 is a fragmentary sectional view of a part of the applicator-dispenser in FIG. 1.
Figure 3:
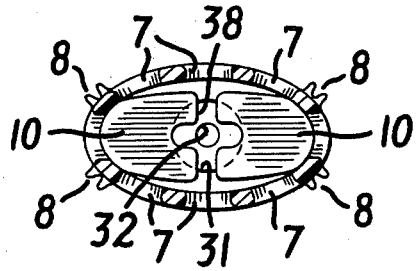
FIG. 3 is a section view taken along section line 3—3.

The inner cover 5 once removed is tubular and can be used as a hair-roller on which hair is twisted or wrapped around for hair styling to assist in holding the hair in position on the hair-roller. The outer cover 13 is placed axially over the hair-roller 5 to grip the hair strands securely in the manner of a clip or clamp. In order to provide an easy fitting of the outside cover 13 onto the hair-roller, it is provided with an axial open 21 extending from the open top lengthwise to the open bottom 23 as seen in FIG. 1 and FIG. 4. The opening allows a radical or outward expansion of the cover as it is pressed on and over the hair on the hair-roller 5 for developement of curls and the like.

The horizontal actuator-lever 24 has spring engagement 28 along with a protuberant-lid 30. The protuberant-lid seats on top of the rim of the added sleeve 36 over and onto the capillary-tube along with the bore-hole or opening 27 are encased inside the globular toggle 34 firmly against the horizontal housing walls 15 in which is rectangular shaped. The housing is an extention of the inside container wall 3. The dome is positioned to fit laterally upon the encased globular-toggle to accompany the snap-on lower base closure tight and permanent sealed.

The inside top portion wall 11 shows the flanked-flange 25 centered breadthwise and bonded inside the hair-roller 5. The horizontal side view prongs 10 are platform sets extended outward with adjacent inside space between the hair-roller walls as seen in section view 3. The flanked flange repel the dispensed contents onto the upper and lower orifices, platforms and apertures and the funnel-top head opening 31 discharges the contents and collects any drip-back liquid from the orifices 38 to return to the tube 32.

Pressure on the actuator-lever pushes the spring inward, moving the protuberant-lid off the sleeve rim, the bore-hole meets the lower vertical capillary-tube and upper vertical tube opening an outlet for the liquid contents, in the manner heretofore described.

After the contents of the container have been expended, the container may be retained for refilling. Those in the art will know that the package may also include additional hair curlers made in a similar as an initial supply of curlers and covers.

I claim:

1. A hair treatment applicator-dispenser comprising, a container for containing; therein a preparation usuable for application to hair; a housing section for holding the mechanism, control and dispenser for contents of said container; a dome receptacle head to direct the dispensed contents and engage the hair curler at the lower portion; said hair curler comprising a removal tubular cover on said container closed at one end and closing said container as a cover and usuable as a hair curler having a length sufficient for wrapping hair therearound; saidcurler including a tubular band removably mounted on said container axially over said curler cover; said band having both ends open when removed from said curler cover, a cross section open parallel to and fitting axially over said cover in use as a hair curler with hair wrapped therearound.

2. A hair treatment applicator-dispenser according to claim 1, a container comprises a built-in housing wall section of the container securing the movable and operational dispensing components controling the inclosed liquid contents.

3. A hair treatment applicator-dispenser according to claim 1, a container comprising a stationary and integral circular top dome receptacle head; said dome receptacle lower portion presses onto and against the housing section, securing permanent contact and leakage of contents is prevented; said dome receptacle head directs dispensed contents outward flow; said dome receptacle head engages the tubular hair curler with an effective fit to include the outside tubular open band cover.

4. A hair treatment applicator-dispenser according to claim 1, in which said curler cover is elongated; said outside band is elongated; and said dome receptacle is also elongated.

5. A hair treatment applicator-dispenser according to claim 1, in which said curler cover has double-row sets of serrations along an axial length thereof on each corner usuable as a hair wrapparound.

6. A hair treatment applicator-dispenser according to claim 1, in which said curler cover comprises a plurality of elipitic shaped surfaces and spaced axially thereon; each having an opening therein.

7. A hair treatment applicator-dispenser according to claim 1, in which said outside band has an axial opening along a path of the open axial length thereof, said opening extending top to bottom of open ends of said band.

8. A hair treatment applicator-dispenser according to claim 1, in which said curler cover comprises a plurality of interior flat surface flatforms axially spaced horizontally onto said curler inside walls; said platforms extend outward; said platforms include an axial cut circumferentially spaced onto said platform extended center edges; said platforms extended sections join to form breadthwise within and near inside horizontal walls.

9. A hair treatment applicator-dispenser according to claim 1, in which comprises an interior sectioned flanked flange, said flanked flange axially spaced midway and breadthwise onto the curler cover ceiling; said flanked flange extend both down and outward; said flanked flange also extend horizontally over and beyond platforms and openings therein.

10. A hair treatment applicator-dispenser according to claim 1, a container encompassing a systematic vertical and direct spray dispensing control unit.

11. A hair treatment applicator-dispenser according to claim 1, in which said container comprises a durable upright spray projection; said container consisting of plastic, metal or combinations using adequate bursting and sealing strength materials in withstanding low or high pressurized contents within and applied.

12. A hair treatment applicator-dispenser according to claim 1, in which container comprising dual purpose features and uses when used as an alternate spray direct from the container and dome receptacle head, when the curler cover and outside band are not attached, and when said curler cover and band are attached; said dome receptacle funnel and tube portion is a conduit for recieveing and retaining any liquid content drip-back that is not completely dispensed; also said funnel and tube portion is the fill and refill section into the container by the user when all contents are expended.

* * * * *